US007832585B2

(12) United States Patent
Sambrailo

(10) Patent No.: US 7,832,585 B2
(45) **Date of Patent: *Nov. 16, 2010**

(54) NINE CONTAINER PER TRAY PACKAGING CONFIGURATION AND METHOD FOR ENHANCED COOLING OF PRODUCE

(75) Inventor: Mark Sambrailo, Watsonville, CA (US)

(73) Assignee: Sambrailo Packaging, Inc., Watsonville, CA (US)

( * ) Notice: Subject to any disclaimer, the term of this patent is extended or adjusted under 35 U.S.C. 154(b) by 1069 days.

This patent is subject to a terminal disclaimer.

(21) Appl. No.: 11/581,064

(22) Filed: Oct. 13, 2006

(65) Prior Publication Data

US 2007/0056980 A1 Mar. 15, 2007

Related U.S. Application Data

(60) Continuation-in-part of application No. 11/481,537, filed on Jul. 5, 2006, now Pat. No. 7,413,094, which is a division of application No. 10/017,893, filed on Dec. 12, 2001, now Pat. No. 7,100,788, which is a continuation-in-part of application No. 09/590,631, filed on Jun. 8, 2000, now abandoned, which is a continuation of application No. 09/060,453, filed on Apr. 14, 1998, now Pat. No. 6,074,676, which is a continuation-in-part of application No. 08/591,000, filed on Jan. 24, 1996, now Pat. No. 5,738,890, said application No. 09/590,631 is a continuation-in-part of application No. 08/591,000, filed on Jan. 24, 1996, now Pat. No. 5,738,890.

(60) Provisional application No. 60/818,929, filed on Jul. 5, 2006.

(51) Int. Cl.
*B65D 21/02* (2006.01)
*B65D 51/16* (2006.01)

(52) U.S. Cl. ..... 220/23.86; 206/509; 220/23.6; 220/23.88; 220/366.1

(58) Field of Classification Search ..... 220/23.6, 220/23.88, 23.4, 366.1, 23.86, 4.23; 206/509
See application file for complete search history.

(56) References Cited

U.S. PATENT DOCUMENTS 1,800,346 A 4/1931 Slagel (Continued)

FOREIGN PATENT DOCUMENTS

AU 2003234951 6/1994

(Continued)

OTHER PUBLICATIONS

Office Action from related Chinese application 02822365.9, dated Dec. 2, 2005.

(Continued)

*Primary Examiner*—Anthony Stashick
*Assistant Examiner*—Niki M Eloshway
(74) *Attorney, Agent, or Firm*—Beyer Law Group LLP

(57) ABSTRACT

The invention encompasses methods and systems loading trays with nine packaging containers. First and second cutouts are arranged on opposite ends of the tray and an approximate dimension of about 16 inches by about 20 inches. Each container has a lid connected to a body with a hinge and securable using latches. The closed lid defines at least two horizontal ventilation slots between the lid and body and at opposite ends of the container. Each container holding about 1 lb of contents with substantially vertical sidewalls. The nine containers are arranged in the tray in three columns of three containers aligning the ventilation slots of the containers with ventilation slots of other containers as well as with the tray ventilation cutouts.

23 Claims, 7 Drawing Sheets

U.S. PATENT DOCUMENTS

| | | | | |
|---|---|---|---|---|
| 1,953,765 | A | | 4/1934 | McCluney |
| 2,088,107 | A | | 7/1937 | Hassenfeld |
| 2,652,335 | A | | 9/1953 | Conti |
| 2,660,529 | A | | 11/1953 | Bloom |
| 2,684,907 | A | | 7/1954 | Brunsing |
| 2,739,734 | A | | 3/1956 | Pugh |
| 2,936,094 | A | | 5/1960 | Smith |
| 3,037,658 | A | | 6/1962 | Schray et al. |
| 3,042,247 | A | | 7/1962 | Bonnet |
| 3,055,572 | A | | 9/1962 | Crane |
| 3,080,087 | A | | 3/1963 | Cloyd |
| 3,148,822 | A | | 9/1964 | Yochum |
| 3,253,762 | A | | 5/1966 | Gaunt |
| 3,567,063 | A | | 3/1971 | Kovach |
| 3,567,107 | A | | 3/1971 | Artz |
| 3,613,938 | A | | 10/1971 | Westcott |
| 3,651,977 | A | | 3/1972 | Morgan |
| 3,741,815 | A | | 6/1973 | Peterson |
| 3,747,802 | A | | 7/1973 | Uroshevich |
| 3,794,090 | A | | 2/1974 | Commisso |
| 3,837,526 | A | | 9/1974 | Medendorp |
| 3,912,118 | A | | 10/1975 | Bird |
| 3,933,296 | A | | 1/1976 | Ruskin et al. |
| 3,937,389 | A | | 2/1976 | Wind |
| 3,979,007 | A | | 9/1976 | Thornbloom |
| 4,143,695 | A | | 3/1979 | Hoehn |
| 4,161,261 | A | | 7/1979 | Frater |
| 4,206,845 | A | | 6/1980 | Christian |
| D256,097 | S | | 7/1980 | Amberg |
| 4,390,113 | A | | 6/1983 | Bird |
| 4,478,344 | A | | 10/1984 | Rehrig |
| D276,216 | S | | 11/1984 | Michaud |
| 4,529,088 | A | | 7/1985 | Quong |
| 4,570,818 | A | | 2/1986 | Borst et al. |
| 4,576,330 | A | | 3/1986 | Schepp |
| 4,597,503 | A | | 7/1986 | Lates |
| 4,618,069 | A | * | 10/1986 | Quong ..... 220/23.4 |
| 4,664,281 | A | | 5/1987 | Falk et al. |
| 4,704,510 | A | | 11/1987 | Matsui |
| 4,741,452 | A | | 5/1988 | Holzkopf |
| 4,767,008 | A | | 8/1988 | Warnecke et al. |
| 4,771,934 | A | | 9/1988 | Kalmanides |
| 4,819,822 | A | | 4/1989 | Box |
| 4,844,263 | A | | 7/1989 | Hadtke |
| 4,859,822 | A | | 8/1989 | Ragusa et al. |
| 4,883,195 | A | | 11/1989 | Ott et al. |
| 4,974,738 | A | | 12/1990 | Kidd et al. |
| D315,100 | S | | 3/1991 | Sheehan |
| 5,046,659 | A | | 9/1991 | Warburton |
| 5,069,344 | A | | 12/1991 | Dehart |
| 5,076,459 | A | | 12/1991 | DeHart |
| 5,118,173 | A | | 6/1992 | Proctor et al. |
| 5,191,994 | A | | 3/1993 | Stauble |
| D339,744 | S | | 9/1993 | Seppala |
| 5,265,749 | A | | 11/1993 | Zutler |
| D343,576 | S | | 1/1994 | Krupa |
| D345,894 | S | | 4/1994 | Krupa |
| D348,608 | S | | 7/1994 | Wyslotsky |
| 5,325,602 | A | | 7/1994 | Nainis et al. |
| 5,339,973 | A | | 8/1994 | Edwards et al. |
| D354,436 | S | | 1/1995 | Krupa |
| 5,423,453 | A | | 6/1995 | Fritz |
| 5,435,449 | A | | 7/1995 | Gelardi |
| D361,035 | S | | 8/1995 | Krupa |
| D361,036 | S | | 8/1995 | Krupa |
| D363,022 | S | | 10/1995 | Krupa et al. |
| 5,456,379 | A | | 10/1995 | Krupa et al. |
| D363,879 | S | | 11/1995 | Krupa et al. |
| 5,465,901 | A | | 11/1995 | Paine |
| 5,497,894 | A | | 3/1996 | Krupa et al. |
| 5,515,993 | A | | 5/1996 | McManus |
| D376,314 | S | | 12/1996 | Krupa |
| D378,192 | S | | 2/1997 | Krupa et al. |
| D379,300 | S | | 5/1997 | Krupa et al. |
| D380,381 | S | | 7/1997 | Krupa et al. |
| D382,795 | S | | 8/1997 | Abayhan et al. |
| D385,784 | S | | 11/1997 | Krupa et al. |
| D393,204 | S | | 4/1998 | Goins et al. |
| 5,738,890 | A | * | 4/1998 | Cadiente et al. ..... 426/106 |
| 5,803,303 | A | | 9/1998 | Timm et al. |
| D409,485 | S | | 5/1999 | Christy, Jr. |
| 5,947,321 | A | | 9/1999 | Vadney |
| 5,964,350 | A | | 10/1999 | Lamarche et al. |
| 6,007,854 | A | | 12/1999 | Cadiente et al. |
| 6,074,676 | A | * | 6/2000 | Cadiente et al. ..... 426/106 |
| 6,257,401 | B1 | | 7/2001 | Mangla et al. |
| D448,288 | S | | 9/2001 | Zettle et al. |
| 6,540,078 | B1 | | 4/2003 | Homent et al. |
| 6,644,494 | B2 | | 11/2003 | Hayes et al. |
| 6,851,551 | B2 | | 2/2005 | Lemaire |
| 6,962,263 | B2 | | 11/2005 | Cadiente et al. |
| 7,100,788 | B2 | * | 9/2006 | Cadiente et al. ..... 220/366.1 |
| 7,413,094 | B2 | * | 8/2008 | Cadiente et al. ..... 220/23.88 |
| 2003/0077363 | A1 | | 4/2003 | Cadiente et al. |
| 2004/0173669 | A1 | | 9/2004 | Kent |
| 2004/0195115 | A1 | | 10/2004 | Colombo |
| 2005/0218150 | A1 | | 10/2005 | Cadiente |
| 2005/0242098 | A1 | | 11/2005 | Cadiente |
| 2006/0027578 | A1 | | 2/2006 | Cadiente |

FOREIGN PATENT DOCUMENTS

| | | |
|---|---|---|
| DE | 857860 | 12/1952 |
| GB | 1074164 | 6/1967 |
| GB | 2160510 | 12/1985 |
| GB | 2200340 | 8/1988 |
| GB | 2341173 | 3/2000 |
| WO | WO 00/20286 | 4/2000 |

OTHER PUBLICATIONS

Search Report from related European application 02757619.8, dated Jun. 23, 2005.

International Search Report from related PCT application PCT/US03/34030 dated Apr. 20, 2004.

International Search Report in related PCT Application PCT/US05/37782 dated Aug. 8, 2007.

Written Opinion in related PCT Application PCT/US05/37782 dated Aug. 8, 2007.

Internet web page, "Double Closure Clamshell", www.i-caenterprises.com, dated Oct. 25, 2005, 1 page.

International Search Report in related PCT application PCT/US02/28338 dated Mar. 12, 2003.

Final Office Action dated Oct. 20, 2009 from U.S. Appl. No. 11/521,233.

Notice of Allowance dated Dec. 8, 2009 from U.S. Appl. No. 11/521,233.

* cited by examiner

NINE CONTAINER PER TRAY PACKAGING CONFIGURATION AND METHOD FOR ENHANCED COOLING OF PRODUCE

CROSS-REFERENCE TO RELATED APPLICATIONS

This application is a Continuation-in-part of prior application Ser. No. 11/481,537, filed Jul. 5, 2006, now U.S. Pat. No. 7,413,094 which is in turn a divisional of prior application Ser. No. 10/017,893, filed Dec. 12, 2001, and allowed as U.S. Pat. No. 7,100,788, which is in turn a continuation-in-part of application Ser. No. 09/590,631, filed Jun. 8, 2000 now abandoned, which is a continuation of application Ser. No. 09/060,453 filed Apr. 14, 1998 and allowed as U.S. Pat. No. 6,074,676, issued on Jun. 13, 2000, both of which are continuation-in-part applications from Ser. No. 08/591,000 now U.S. Pat. No. 5,738,890 issued on Apr. 14, 1998 (and filed on Jan. 24, 1996). This application also claims priority to U.S. Provisional Patent Application 60/818,929 of the same name filed Jul. 5, 2006. This application also claims priority to prior application Ser. No. 11/474,096, filed Jun. 22, 2006, which is in turn a continuation-in-part of application Ser. No. 10/017,893, filed Dec. 12, 2001, and allowed as U.S. Pat. No. 7,100,788 (as indicated above), which is in turn a continuation-in-part. Accordingly, this patent hereby claims priority from all of the foregoing issued patents and patent applications under 35 U.S.C. §120.

TECHNICAL FIELD

The present invention relates to an improved method and produce packaging configuration enabling the improved packing, cooling, storage, and shipping of produce. More particularly, the present invention improves a flow of cooling air through a container system (comprising vented produce containers aligned in vented holding trays) and increases the packaging density of pallets.

BACKGROUND

Many produce products are harvested and packed in the field into containers which are ultimately purchased by the end consumer. Examples of such produce items include, but are not limited to, tomatoes, berries (including, but not limited to raspberries, strawberries, blueberries and so on), grapes, mushrooms, radishes and broccoli florets. Many of these produce items require substantial post-harvest cooling in order to enable shipping over long distances and to prolong shelf life. Additionally, increased fuel costs make high packing densities increasingly advantageous for reasons to be explained in greater detail below.

In use, a grower's harvesting crew harvests produce items of the type previously discussed directly from the plant in the field into the container. The containers are then loaded into trays, which contain a specific number of individual containers and the trays, when filled, are loaded onto pallets. The most common pallet used in the produce industry in the United States is the forty by forty-eight inch (40"×48") wooden pallet, and the vast majority of produce handling, storage and shipping equipment is designed around pallets of this size.

After the pallets have been filled and loaded in the field, they are transported to shippers who perform a variety of post-harvest processes to enhance the marketability of the produce itself. For many types of produce, including berries, a significant packing evolution is the post-harvest cooling of the packed fruit. Indeed, berry shippers are often referred to as "coolers". The process of cooling berries typically includes injecting a stream of cooling air into one side of a tray and thence through the individual baskets and around the berries stored therein. As the air cools the berries, it picks up heat which is exhausted from apertures on the opposite side of the tray.

In one common usage the produce is loaded into a one pound (1 lb.) container. Almost exclusively, eight (8) one pound baskets are loaded into a packaging tray. Such a configuration has existed since the introduction of the clear plastic packaging basket. All freight, storage, and sales pricing is calculated with this configuration in mind. Thus, in the industry there is considerable inertia and history behind this eight to a tray packing configuration.

Once trays are loaded commonly used packaging configuration are used. One such is referred to in the industry as the so-called "five-down" packaging configuration. It is referred to a five down package because at each layer of a pallet five "trays" are stacked. Each of the "trays" is loaded with produce containers filled with produce. In some approaches each of the trays has many vents all over each side of the tray or no vents at all. In such cases the prior art has not paid much attention to vent placement. The point of this prior philosophy being that more vents is better. Alternatively, in many systems no tray vents at all are used.

Importantly, none of the prior art technologies paid any attention to the cooling, packing, or shipping efficiencies of the various configurations. In particular, no attention was paid to integrating the tray vents with vents in the produce containers (in those cases where the produce containers actually had vents). No attention was given to the idea of specifically sized and shaped containers or to placed in the containers and trays in a specific alignment to maximize produce cooling or to maximize pallet content.

These same defects are known to be a problem with other pallet loading configurations. For example, pallet loading configuration such as a six-down system comprising six (6) trays per layer on the pallet. This implementation also employs an eight (8) one pound basket per tray loading configuration. Again, this means that 48 pounds of fruit are packed per layer on a standard 40 inch by 48 inch pallet. As currently employed, the current six down configuration suffers from sub-optimal tray and container packing. Neither the trays nor the containers shipped therein are fitted together properly. Thus, the package does not fully utilize the surface area of a 40"–48" pallet. Therefore, current use packages and trays under-utilize the pallet. This frequently leads to still higher costs. This same problem is found to exist across all size ranges for produce shipping trays and containers.

The industry has been using trays loaded with eight one pound plastic containers per tray since the introduction of the modern plastic container by Sambrailo Packaging twenty years ago. There is significant resistance in the industry to any changes in packaging formats. This problem has prevented the industry from changing from the eight per tray format. All distributors, shippers, and manufacturers have relied upon containers particularly formatted to this eight container per tray.

What is needed is a packaging method and cooling configuration that can fully take advantage of the packing space available on a standard 40"×48" pallet and also available using a standard footprint 16 inch by 20 inch tray and provide improved cooling performance over the prior art. Moreover, there is a need for an improved berry packing system which will significantly reduce the cooling time and cooling expense for the fruit contained in the baskets. To make such an improved system feasible, it must interface with commonly used and preferred facilities and apparatus (e.g., the previously discussed forty by forty eight inch pallets in current use in the grocery industry).

Accordingly, what is needed is a packaging configuration and approach that provides increased cooling performance and increased packing density using standard pallet formats.

SUMMARY OF THE INVENTION

In accordance with the principles of the present invention, an improved system and method for packaging, transporting, storing, and cooling produce are disclosed.

In general, the present invention is directed toward methods and produce packaging systems that improve cooling rates for harvested produce and increase packing density on a standard size pallet thereby increasing the per pallet produce volume.

One embodiment of the invention comprises a produce packaging and shipping system involving a produce packaging tray loaded with nine produce packaging containers. The tray having a venting arrangement with first and second cutouts arranged on opposite ends of the tray and also having an approximate dimension of about 16 inches by about 20 inches. The nine containers each have a lid that is connected to a body with a hinge and securable using latches. When the lid is closed it defines at least two horizontal ventilation slots between the lid and body with the slots being arranged at opposite ends of the container. Each container sized to hold about 1 lb of produce product. The container is configured with exterior width dimensions of in the range of about (4½-5½ inches) and exterior length dimensions of about (6-6¾ inches), and having a more vertical sidewall then current products. Accordingly, embodiments of the clamshell include substantially vertical sidewalls. The nine containers are arranged in the tray in three columns of three containers so that the ventilation slots of the containers of each row of containers are in alignment with the trays, enabling airflow to pass into the tray through the first cutout into the ventilation openings of the containers and through each of the containers by ventilation slots of other packaging containers in the same row of containers. Additionally, the ventilation slots of the containers of each row are in alignment with the ventilation cutouts of passing through the aligned ventilation slots of the containers and out of the cooling tray through the second cutout at the opposite end of the tray.

In another embodiment the invention describes a produce packing method. The method involves providing a produce packaging tray having an approximate dimension of about 16 inches by about 20 inches. The tray including a venting arrangement having first and second cutouts positioned at opposite ends of the tray from each other. Nine produce packaging containers are provided. Each container having a lid connected to a body with a hinge and further configured such that when the lid is closed it defines at least two horizontal ventilation slots between the lid and body, the slots being disposed at opposing ends of the container, with each container adapted to contain about 1 lb of produce product, each container having an exterior width dimension of in the range of about 5 inches to about 5½ inches and an exterior length dimension of in the range of about 6 inches to about 6¾ inches, and having substantially vertical sidewalls. The method involving arranging the nine containers in the tray to form a packing layer comprising three columns of containers with each column having three containers positioned so that the ventilation slots of the packaging containers of each column of containers are in substantial alignment with ventilation slots of other packaging containers in the same column of containers, and further arranging the containers so that the ventilation slots of the containers of each column of containers are in substantial alignment with the ventilation cutouts of the trays. This arranging enables airflow to pass into the tray through the first cutout into the ventilation openings of the containers of the arrangement and through each of the containers of the arrangement by passing through the aligned ventilation slots of the containers and out of the cooling tray through the second cutout at the opposite end of the tray.

In another embodiment, the invention comprises a packing system configured to enhance cooling properties and increase packing density. The includes a produce packaging tray having a bottom and sidewalls with an approximate dimension of about 16 inches by about 20 inches and including a venting arrangement with a first cutout at a top portion of a first sidewall of the tray at a first end of the tray and a second cutout at a top of a second sidewall of the tray at a second end of the tray at the opposite end of the tray from the first cutout. The first and second cutouts are arranged to enable alignment with ventilation the slots of containers placed in the tray as a second layer of containers arranged on top of a first layer of containers. The tray further including intermediate height cutouts. The intermediate cutouts include a third cutout in the first sidewall arranged between the first cutout and the bottom of the tray, the height of the third cutout further arranged so that it can be aligned with ventilation slots of the first layer of containers placed in the tray. The intermediate cutouts also include a fourth cutout in the second sidewall between the second cutout and the bottom of the tray, the height of the fourth cutout arranged so that it can be aligned with ventilation slots of first layer of containers. The system further including a plurality of produce packaging containers adapted to contain about 8 oz. of produce product, with each container having an exterior width dimension of in the range of about 5 inches to about 5½ inches and an exterior length dimension of in the range of about 6 inches to about 6¾ inches, and having substantially vertical sidewalls. Moreover, the container lids are connected to a body using hinges. The lids are capable of being secured in a closed position using latches and further configured such that when the lid is closed it defines at least two horizontal ventilation slots positioned at opposite ends of the container between the lid and body. The containers are arranged inside the tray as first layer of nine containers set on the bottom of the tray, arranged in three columns of containers with each column having three containers. The containers further arranged so that ventilation slots of the packaging containers of each column of the first layer are in substantial alignment with ventilation slots of other packaging containers in the same column of containers in the first layer. Also, wherein the ventilation slots of the containers of each column of containers in the first layer are in substantial alignment with the third and fourth cutouts of the trays. This enabling airflow to pass into the tray through the third cutout, into the ventilation openings of the containers of the first layer and through each of the containers of the first layer by passing through the aligned ventilation slots of the containers and out of the cooling tray through the fourth cutout at the opposite end of the tray. The second layer of containers comprising nine produce packaging containers arranged on top of the first layer in three columns of three containers per column. The containers further arranged inside the tray so that ventilation slots of the containers of each column of the second layer of containers are in substantial alignment with ventilation slots of other packaging containers in the same column of containers of the second layer and wherein the ventilation slots of the packaging containers of each column of the second layer are in substantial alignment with the first and second cutouts of the trays. This enabling airflow to pass into the tray through the first cutout, into the ventilation openings of the containers of the second layer and through each of the containers of the second layer by passing through the aligned ventilation slots of the containers and out of the cooling tray through the second cutout at the opposite end of the tray.

In another system embodiment, the invention includes a produce packaging tray having a bottom and sidewalls and an approximate dimension of about 16 inches by about 20 inches. The tray includes a venting arrangement with a first cutout in a first sidewall at one end of the tray and a second cutout in a second sidewall at an opposite end of the tray from the first cutout. Six produce packaging containers are arranged in the tray. Each container adapted to hold about 2 lbs of produce and includes a lid that is connected to a body with a hinge and configured so that the closed container can be secured with latches. When the lid is closed it defines at least two horizontal ventilation slots between the lid and body with the slots being disposed at opposing ends of the container. The containers being arranged in the tray in two columns of containers with each column having three containers with each container having an exterior width dimension of about 5 inches to about 5½ inches and an exterior length dimension of about 9 inches to about 10 inches, and having substantially vertical sidewalls. The containers further arranged inside the tray so that ventilation slots of the containers are in alignment with ventilation slots of other containers in the tray and wherein the ventilation slots of the containers are in alignment with the ventilation cutouts of the trays. This enabling cooling airflow to pass into the tray through the first cutout into the ventilation openings of the containers and through each of the containers by passing through the aligned ventilation slots of the containers and out of the cooling tray through the second cutout at the opposite end of the tray.

Other aspects and advantages of the invention will become apparent from the following detailed description and accompanying drawings which illustrate, by way of example, the principles of the invention.

BRIEF DESCRIPTION OF THE DRAWINGS

The following detailed description will be more readily understood in conjunction with the accompanying drawings, in which.

It is to be understood that in the drawings like reference numerals designate like structural elements. Also, it is understood that the depictions in the Figures are not necessarily to scale.

DETAILED DESCRIPTION OF THE INVENTION

The present invention has been particularly shown and described with respect to certain embodiments and specific features thereof. The embodiments describe here are to be taken as illustrative rather than limiting. It should be readily apparent to those of ordinary skill in the art that various changes and modifications in form and detail may be made without departing from the spirit and scope of the invention.

Figure 1A:
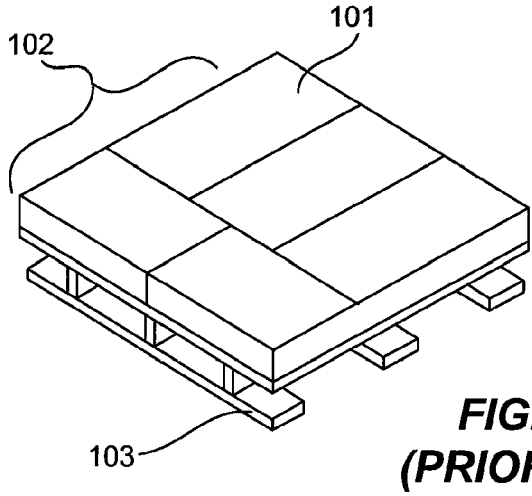
FIG. 1A (PRIOR ART)
FIGS. 1A and 1B are simplified perspective views of conventional tray packing layers used to package produce on a pallet without significant ventilating alignment between the trays.
Figure 1B:
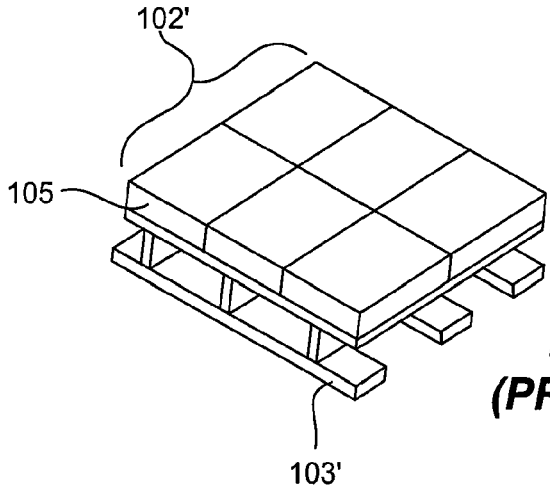
FIG. 1B (PRIOR ART)
Figure 1C:
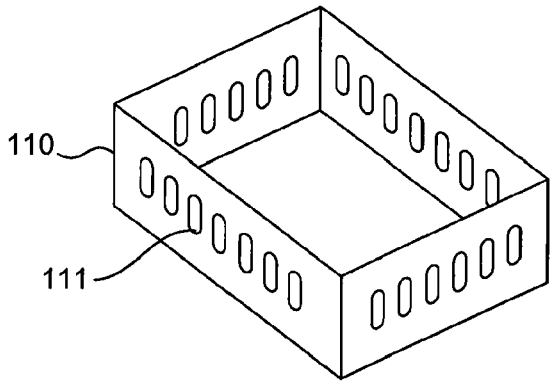
FIG. 1C (PRIOR ART)
FIG. 1C is a perspective view of a prior art produce packaging container without alignable ventilation apertures in the tray.

FIGS. 1A and 1B depict prior art pallet layer configurations use various conventional packaging schemes. FIG. 1A depicts a so-called "five-down" packaging configuration having five trays 101 sized and arranged to fit on a layer 102 of a standard 40"×48" pallet 103. FIG. 1B depicts a so-called "six-down" packaging configuration having six trays 101' sized and arranged to fit on a layer 102' of the same size pallet 103. These trays are commonly filled with eight produce containers with successive layers of trays stacked over one another. FIG. 1C depicts an example of a prior art vented tray 110. The vented tray includes a number of vents 111 arranged about its outer walls to permit airflow into the tray. Importantly, these vents are arranged with no particular attention paid to the type of packaging container. This configuration is of a "one size fits all" configuration. No consideration is given to the unique advantages inherent in embodiments of the invention where tray container vent alignment is crucial.

Generally, the principles of the invention encompass packaging and cooling methods and systems designed to improve cooling efficiencies, reduce damage to the contents of containers, and increase product packing density. A system of the present invention incorporates baskets loaded into trays and trays loaded in preferred configurations on a pallet. The trays are loaded with baskets arranged in the tray so that ventilation slots and/or channels of the baskets are aligned with tray ventilation features.

In one particularly advantageous implementation, the inventors contemplate that a tray having an approximate dimension of 16 inches by 20 inches can be loaded with nine (9) produce containers, each containing one pound of produce product. In related approaches, a double-layered tray can be loaded with two layers of nine (9) produce containers (per layer) with a top layer of nine containers placed on top of a similar bottom layer of nine containers. In this approach the containers are eight (8) ounce (oz.) or one pint (pt.) containers. Additionally, the inventors contemplated that six (6) two pound (2 lb.) containers can be loaded into a tray with an approximate 16 inch by 20 inch footprint. Such 16 inch by 20 inch trays can be loaded six trays to a pallet layer and loaded as high as 17 to 20 pallet layers high. In an additional implementation, six (6) trays can be loaded onto the standard pallet in a 2 by 3 configuration.

It must be pointed out that these configurations currently face significant resistance from the agricultural and grocery industries which are invested in older less efficient approaches and technologies.

Additionally, the inventive containers, trays, and packaging arrangements are arranged so that the tray ventilation features are in alignment with ventilation features of other trays of the same layer. Also, the ventilation features of the trays are aligned with the ventilation features of the containers held within the trays. As will be discussed below, these configurations are contrary to many established trends and practices in the industry. However, even so, they provide a number of cost advantages and surprising cooling advantages relative to the known standard packaging configurations.

FIGS. 1A and 1B depict tray stacking configurations that can be employed to stack trays of the present invention onto a standard 40" by 48" used in many shipping applications. FIG. 1A depicts a so-called "five-down" packaging configuration having five trays 101 sized and arranged to fit on a layer 102 of a standard 40"×48" pallet 103. FIG. 1B depicts a so-called "six-down" packaging configuration having six trays 101' sized and arranged to fit on a layer 102' of the same size pallet 103. These trays are commonly filled with produce containers with successive layers of trays stacked over one another.

Figure 2A:
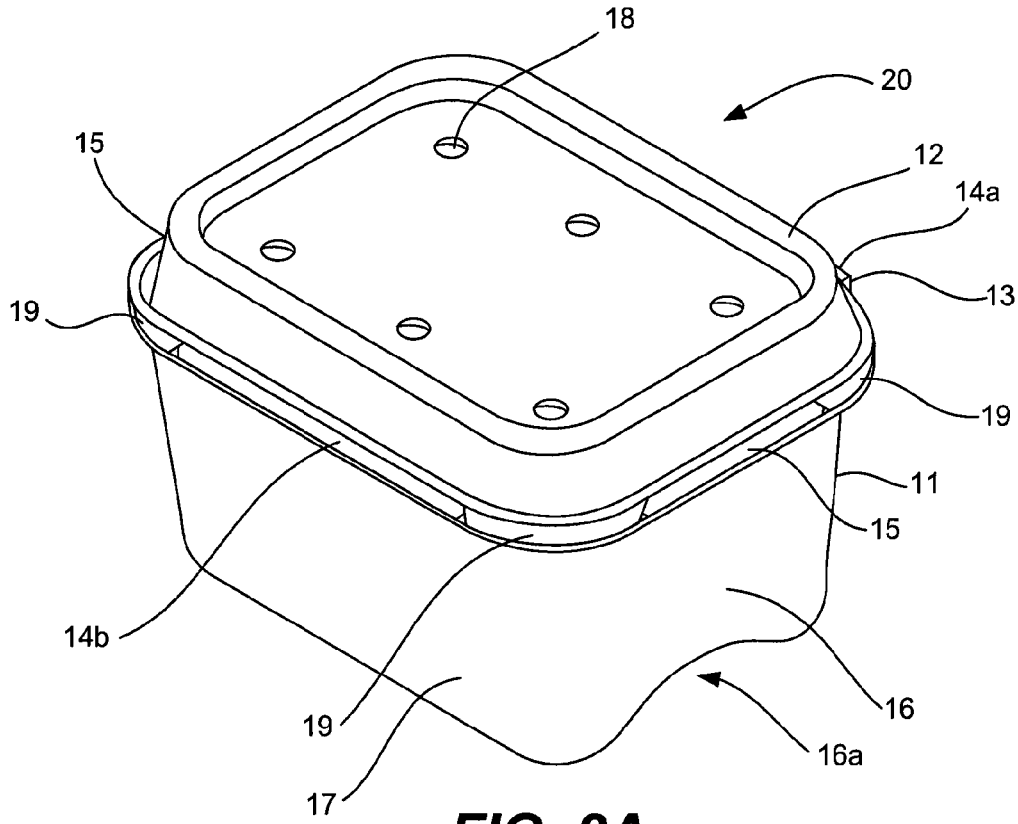
FIG. 2A is simplified perspective view of an embodiment of a produce packaging container in accordance with the principles of the invention.

FIG. 2A schematically depicts one embodiment of a produce basket 20 of the present invention. The depicted produce basket 20 embodiment is a one-piece structure incorporating both basket body 11 and lid 12. In this embodiment, a hinge 13 joins basket body 11 and lid 12. It is to be noted that embodiments of the invention include baskets in a two-piece format that have a lid and body without a hinge. And also include baskets having two hinged lids that are closed together to seal the basket. An example of one such dual lidded approach is described in U.S. patent application Ser. No. 11/177,107, filed Jul. 7, 2005, entitled: "Produce Packaging System Having Produce Containers with Double Arched Bottom Ventilation Channels" incorporated by reference for all purposes.

One typical embodiment comprises a "1 pound" container for holding one pound of produce product. Such a container typically has an exterior width dimension of in the range of about 5 inches to about 5½ inches and an exterior length dimension of in the range of about 6 inches to about 6¾ inches, and stands about 3½ to about 4½ inches tall. Importantly, the sidewalls of the container are substantially vertical. This means that the angle $\phi$ of the sidewalls from the horizontal is in the range of about 87-90° (degrees). This is steeper than the sidewalls of commonly used containers that use sloped sidewalls with an angle of on the order of 84° or less (i.e., a greater slope). This small change to a more upright container with substantially vertical sidewalls (that is to say about 2-3° cant off of 90° instead of the common sloped sidewall of 6° or more cant off of 90°) alters the size of the container just enough to enable nine 1 lb containers to be fitted into each tray. This increased density format translates into a 12-14% increase in the amount of produce that can be packed in each tray. Accordingly, this translates into a significant increase in the amount of produce that can be loaded onto each pallet. Given the steady increases in fuel prices, this increased product packing density represents a significant cost savings. When coupled with the increased cooling efficiencies inherent in this patented technology, this invention represents a significant step forward in terms of cost savings and cooling efficiency.

Referring back to FIG. 2A, the closed lid 12 now defines a ventilation slot 15 between the lid 12 and basket body 11 enabling a cooling airflow to enter the container 20. The airflow exits through a matching ventilation slot (not shown in this view) at the opposite of the container 20. These features are well described in previously issued U.S. Pat. Nos.: 5,738,890; 6,007,854; 6,074,676; and 6,962,263 which are hereby incorporated by reference for all purposes. The point being that variously shaped and sized ventilation slots are positioned at either end of the container to enhance cooling flow. The applicants believe that elongate horizontal slots 15 provide the best cooling results. Additionally, the lid 12 and the bottom of the body 11 can include ventilation apertures 18 configured to enhance ventilation through the container. In order to further enhance cooling the depicted embodiment includes an arched bottom 16 that defines a ventilation channel 16*a* under the container 20. Additionally, more than one channel can be formed under a side of the container. Moreover, arched bottoms can be formed in a bottom portion of an adjacent wall 17 of the container to facilitate ventilating cross flow. Alternatively, feet or protrusions can be added to the bottom of some embodiments to enable a cooling cross flow of air to pass underneath the container in more than one direction. Such issues are addressed in greater detail in U.S. Pat. No. 6,962,263 which was previously incorporated by reference for all purposes. Moreover, similar issues are addressed in the U.S. patent application Ser. No. 10/302,059, filed Nov. 21, 2002, entitled: "Produce Packaging System Having Produce Containers with Double Arched Bottom Ventilation Channels" and U.S. patent application Ser. No. 11/177,107, filed Jul. 7, 2005, entitled: "Produce Packaging System Having Produce Containers with Double Arched Bottom Ventilation Channels" both incorporated by reference for all purposes.

Also, the depicted embodiment is shown with a ventilation slot 14*a* that passes through the hinge 13 and an opposing ventilation slot 14*b* in the front face of the container opposite the hinge. This hinge vent slot 14*a* enables directional ventilation flow through the top portion of the container. Slots 14*a* and 14*b* enable a cross flow that is transverse to the flow enabled by slots 15. In a related embodiment, vent slot 14*a* can comprise several vents through the hinge which still accomplishing the purposes of the invention. Alternatively, the slots 14*a* and 14*b* need not be used at all. They are shown here for completeness.

The inventors point out that the lid 12 of the container 20 is secured to the body 11 using a number of latching mechanisms. Such latches 19 are generally releasable, enabling a consumer to easily access the produce closed inside. Here in the depicted embodiment, four "edge catch" latches are used to secure the lid in a closed configuration. However, numerous other latching mechanisms can be employed to secure the lid, these include, but are specifically not limited to, edge catches, button catches, snaps, hook-and-loop closures, and other closure methodologies well-known to those having ordinary skill in the art. Moreover, the term "latch" as used herein may further comprise alternative lid closure methodologies known to those having ordinary skill in the art including shrinkwrap banding the lid to the body, and the use of elastic bands or adhesive tapes to perform this latching function.

The inventors also specifically point out that instead of venting through the hinge or even at the interface between the lid and body, the vents can be located in the sidewalls of the lid to facilitate cooling flow through the container. Additionally, the inventors specifically contemplate "flat-bottomed" containers that have flat bottoms without the arched bottoms of the containers depicted in, for example, FIG. 2A.

Figure 2B:
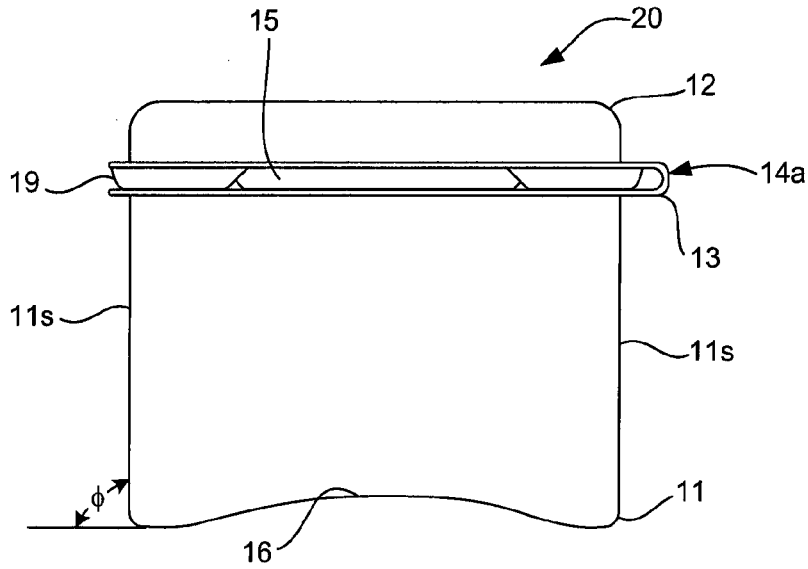
FIG. 2B is simplified side view of the embodiment of a produce packaging container as shown in FIG. 2A.

FIG. 2B is a schematic side view of the embodiment shown in FIG. 2A. The one piece produce basket 20 has a lid 12 closed onto basket body 11 and secured with the latches 19. As mentioned above, the container can be a number of different sizes including a 2 lb container, a 1 lb container, an 8 oz. container, as well as a range of other sizes.

This depiction provides a good view of an embodiment having substantially vertical sidewalls 11*s*. Again, substantially vertical sidewalls 11*s* mean that the angle ϕ of the sidewalls 11*s* from the horizontal is in on the order of about 87-90° (degrees) providing a cant of about 2-3° cant off of 90° instead of the more standard 6° of more cant off or 90°. When each of the four sidewalls are substantially vertical, the maximum packing density can be obtained. The closed lid 12 defines a ventilation slot 15 between the lid 12 and basket body 11 enabling a cooling airflow to enter the container 20. The airflow exits through a matching ventilation slot (not shown in this view) at the opposite of the container 20. In some embodiments vents 14*a* can be made in the hinge 13. The arched bottom 16 that defines a ventilation channel under the container 20 is well shown in this view. Additionally, more than one channel can be formed under a side of the container. Moreover, arched bottoms can be formed in a bottom portion of an adjacent wall 17 of the container to facilitate ventilating cross flow. Alternatively, feet or protrusions can be added to the bottom of some embodiments to enable a cooling cross flow of air to pass underneath the container in more than one direction. Such issues are addressed in greater detail in U.S. Pat. No. 6,962,263 which was previously incorporated by reference for all purposes. Moreover, similar issues are addressed in the U.S. patent application Ser. No. 10/302,059, filed Nov. 21, 2002, entitled: "Produce Packaging System Having Produce Containers with Double Arched Bottom Ventilation Channels" and U.S. patent application Ser. No. 11/177,107, filed Jul. 7, 2005, entitled: "Produce Packaging System Having Produce Containers with Double Arched Bottom Ventilation Channels" both incorporated by reference for all purposes.

Also, the depicted embodiment is shown with a ventilation slot 14*a* that passes through the hinge 13 and an opposing ventilation slot 14*b* in the front face of the container opposite the hinge. This hinge vent slot 14*a* enables directional ventilation flow through the top portion of the container. Slots 14*a* and 14*b* enable a cross flow that is transverse to the flow enabled by slots 15. In a related embodiment, vent slot 14*a* can comprise several vents through the hinge which still accomplishing the purposes of the invention. Alternatively, the slots 14*a* and 14*b* need not be used at all. They are shown here for completeness.

Figure 3:
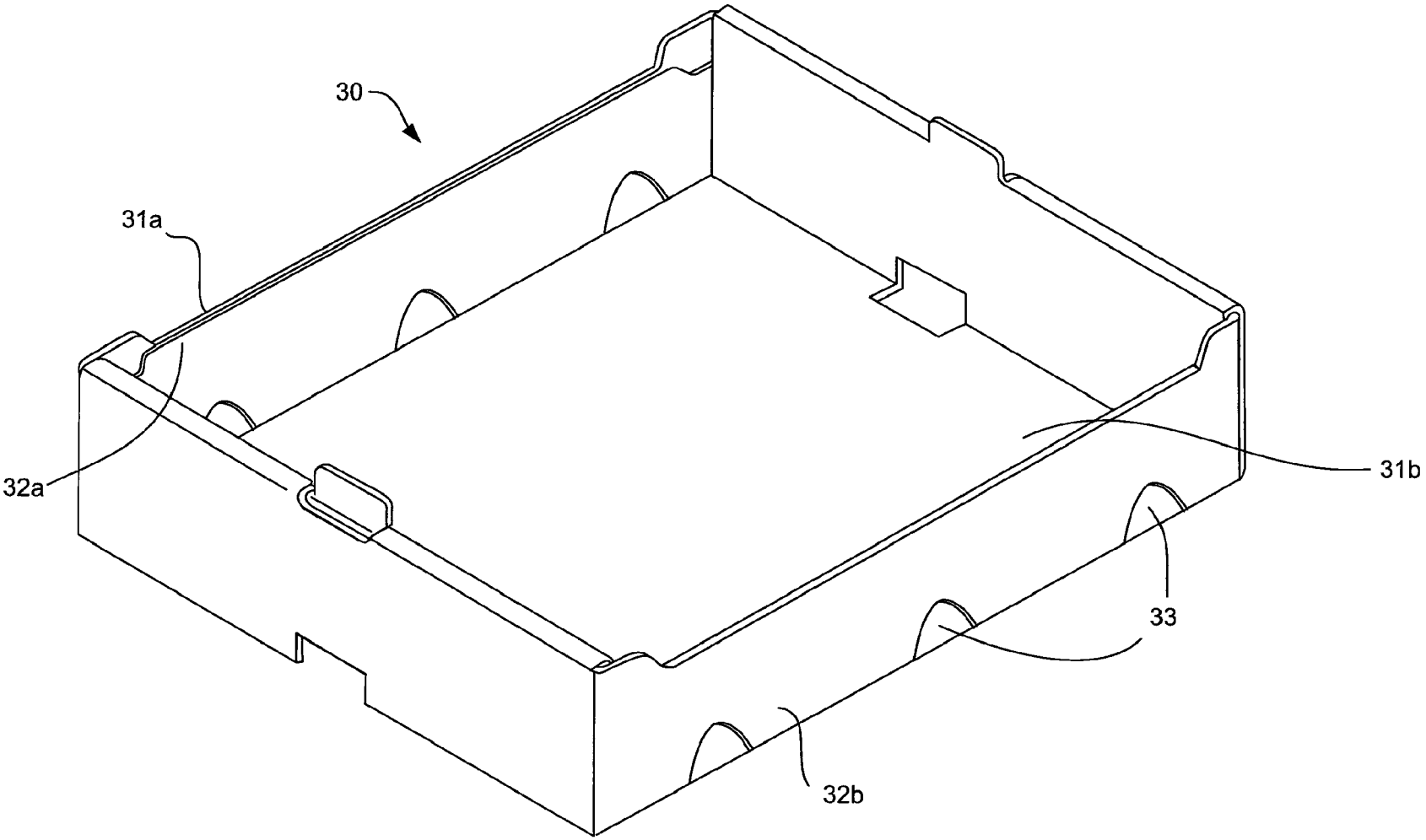
FIG. 3 is a simplified perspective view of a tray embodiment of the present invention.

FIG. 3 shows a perspective view of a tray embodiments sized for packaging with a standard 40"×48" pallet. The produce packaging tray 30 has an approximate dimension of about 16 inches by about 20 inches. The trays feature a venting arrangement with cutouts 31*a* and 31*b* on opposing sidewalls 32*a* and 32*b*. The depicted cutouts are at the top portion of the sidewalls and are sized to enable ventilative flow to pass through the cutout and into the venting slots of the containers placed in the tray. Alternatively, a number of smaller slots can be placed in the sidewalls instead of the single cutout (31*a*, 31*b*) shown for each wall. Alternatively, other embodiments can have ventilation cut out placed in the sidewall at a height between the tray bottom and the depicted cutouts. These will be shown in another depicted embodiment.

Still referring to FIG. 3, bottom ventilation first openings (or bottom cutouts) 33 are shown at the bottom of the sidewalls. Although, not necessary to practice the invention, these bottom ventilation openings provide certain advantageous features and are particularly useful when aligned with the ventilation channels formed under the produces container. For example, the arched bottom 16 of FIGS. 2A and 2B depict one approach to such bottom ventilation and forming of a ventilation channel under the containers. The openings 33 are aligned with the ventilation channels (e.g., 16*a*) of the containers to provide an effective method for passing a cooling airflow under all containers and then out through the opposite end of the tray. In an alternative embodiment, the ventilation openings can be merged into one larger opening. However, the inventors believe that the trays are structurally more robust when used with the plurality of bottom ventilation openings 33 depicted here. Of course, the inventors contemplate many different sizes, shapes, and other associated ventilation approaches and specifically consider that these related approaches form part of the invention.

Figure 4:
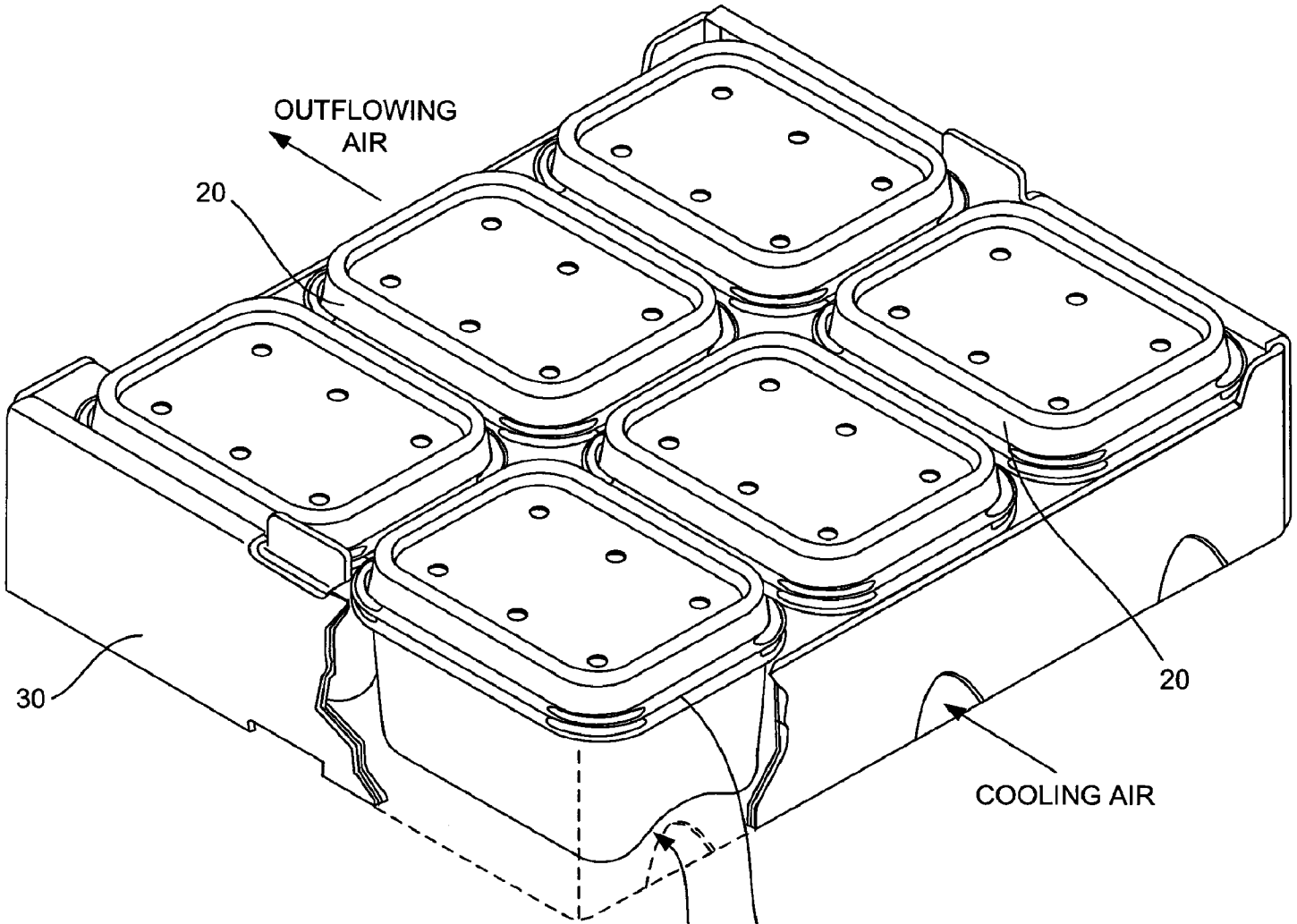
FIG. 4 is a perspective view of a tray embodiment of the present invention loaded with packaging containers in accordance with the principles of the invention.

FIG. 4 depicts a tray 30 loaded, in accordance with the principles of the invention, with nine inventive containers 20. Tray ventilation features are depicted. Such features here include upper and lower vents in the tray. The upper cutouts 31 and the bottom ventilation openings 33 are well shown in this particular depicted embodiment. The inventive containers and trays of the patented system are arranged of a particular size with advantageously shaped and positioned ventilation openings. One of the features of the system is that the containers and trays are configured so that when the containers are loaded into a tray, the tray vents and container vents (and channels) are in substantial alignment with each other enabling cooling air flow into the containers even while loaded in the trays. In the depicted embodiment, two opposed cutouts 31 are aligned and arranged to enable the vent slots 15 of the containers to facilitate effective cooling airflow. In some other embodiments, the vents and openings can be of a similar size (i.e., the vent at the top of the sidewall is replaced by a plurality of cutouts sized to accommodate the vent slots of the containers). This maximizes cooling effect on the contents of the containers by insuring that the majority of the cooling flow passing into tray openings passes into the containers through the container ventilation slots or through the ventilation channels created.

The inventive system and packaging method enables high packing density and superior cooling performance achieved by a specially designed family of produce containers ("clamshells") having particularly positioned and shaped ventilation slots optionally coupled (and optionally, particularly positioned and shaped ventilation channels) integrated with specifically mated ventilation features of a tray, further integrated with an aligned tray loading configuration arranged on each layer of a shipping pallet.

Again referencing FIG. 4, a loaded tray 30 filled with nine containers 20 arranged in a three by three layer of containers arranged to take advantage of the ventilation slots and openings of both the tray and the baskets. The inventors specifically point out that this loading regime is one of many possible loading arrangements contemplated by the inventors. For example, the trays can be configured to accommodate two or more layers of baskets. For example, the loaded tray can be filled with 18 half pound baskets (such as are commonly used with raspberries and other fruits) arranged to take advantage of ventilation slots and openings in the trays. Additionally, of the configurations and arrangements may be employed (e.g., the trays may be configured to accommodate six (6) two pound baskets or in a further example eighteen (18) six oz. baskets per tray). The inventors further contemplate many other loading configurations.

The depicted containers 20 can be formed of a number of different materials, however, clear plastic container is preferred. The depicted embodiment is a vacuum formed one piece plastic structure with hinged lid. The inventors point out that the principles of the present invention are equally applicable to alternative materials and manufacturing technologies. In one embodiment of the present invention, the basket is formed of Kodapak® PET Copolyester 9921, available from Eastman Kodak. Alternative materials include, but are not limited to various polymeric and monomeric plastics including but not limited to styrenes, polyethylenes including HDPE and LPDE, polyesters and polyurethanes; metals and foils thereof; paper products including chipboard, pressboard, and flakeboard; wood and combinations of the foregoing. Alternative manufacturing technologies include, but are again not limited to thermocasting, thermoforming; casting, including die-casting; thermosetting; extrusion; sintering; lamination; the use of built-up structures and other processes well known to those of ordinary skill in the art. Commonly, the lid is secured to the basket body using a latch mechanism. As described previously, many different latching mechanisms can be employed and moreover, the term "latch" as used herein may further comprise alternative lid closure methodologies known to those having ordinary skill in the art.

With continued reference to FIG. 4 the tray 30 is shown with optional lower ventilation openings 33 that are in alignment with the ventilation channels 16 (shown in the cutaway portion of the lower left side) to enable a cooling airflow to pass into the tray and under the containers through the successively aligned ventilation channels 16 of the containers 20. Additionally, upper ventilation openings 15 are provided to enable air to flow into and through the containers 20. In the depicted embodiment, the upper ventilation openings 15 are aligned with the large tray cutouts 31. Alternatively, several smaller cutouts sized at about the same width as the ventilation slots 15 of the containers can be arranged in the sidewalls of the tray in alignment with the loaded trays to provide ventilation access to the all of the containers 20. Additionally, the upper ventilation openings 31 need not comprise cutouts, but rather can be slots cut into the tray. These slots can be sized and spaced to enable airflow into the ventilation slots of the containers 20. It can be seen with reference to FIG. 4 that the ventilation slots 15 are aligned with each other. The baskets 20 of each row are aligned so that ventilation slots 15 of the baskets are adjacent to and aligned with ventilation slots of other baskets in the row. Thereby, the flow of air into the tray proceeds through the ventilation openings into the ventilation slots of each basket in the row through the baskets and out the opposite end ventilation slot where it passes through the ventilation slot of the next basket and so on until it exits the tray by the opposite end ventilation opening. This provides substantially improved cooling.

The inventors point out that while some embodiments make use of lower ventilation openings 33 that are in alignment with the ventilation channels 16 and upper ventilation openings 31 are provided to enable air to flow into and through the containers 20, other embodiments can be employed using trays having only upper ventilation openings or only lower ventilation openings 33 depending on the need, requirements, and desires of the end user.

While the preceding discussion regarding a first set of embodiments has centered on a one piece basket incorporating the basket body and lid joined by a hinge, it will be immediately apparent to those of ordinary skill in the art that the principles of the present invention may with equal facility be embodied in a two piece implementation utilizing a separate body and lid. This embodiment is specifically contemplated by the teachings of the present invention.

Additionally, continued research into produce cooling has shown that some produce type/quantity combinations require different velocities of cooling air to achieve optimal cooling. This can be attained by altering the size of slots 15. For example, in some implementations, the vertical extent of slot 15 can be substantially increased upwardly or downwardly from the embodiment shown in FIG. 4. Yet another cooling regime may be implemented in accordance with the teachings of the present invention. For example, the previously discussed cooling channel 16 and its associated tray openings 33 can be eliminated.

The inventors point out that the embodiments can be formed of cut and folded corrugated cardboard formed in a manner well known to those of skill in the art. One such corrugated cardboard is Georgia-Pacific USP120-USP85-USP120, although any number of packaging materials well known to those of ordinary skill in the art could, with equal facility, be used. Such alternative materials include, but are not limited to various cardboards, pressboards, flakeboards, fiberboards, plastics, metals and metal foils. Alternatively or additionally, tray embodiments using additives, coatings, and/or liners are contemplated by the inventors. For example, wax treated papers, or plastic coated trays can be used and are well within the contemplated inventive aspects of the invention. In some embodiments of a tray, it may further be advantageous to incorporate a gluing, adhesive or fastening step in fabrication of the tray, again in accordance with generally accepted practices in container design and fabrication.

When smaller sized trays are employed with the present invention, a lighter grade of corrugated board can be used for their manufacture than are trays required to support the greater weight and greater area of larger baskets. This lighter weight not only minimizes shipping costs, but can significantly reduce packaging costs for the shipper, again lowering consumer costs. The principles of the present invention may be implemented using alternative tray materials including, but are not limited to various polymeric and monomeric plastics again including but not limited to styrenes, polyethylenes including HDPE and LPDE, polyesters and polyurethanes; metals and foils thereof; paper products including chipboard, pressboard, and flakeboard; wood; wire; and combinations of the foregoing. Additionally, materials such as polyvinyl alcohols and poly lactic acid can be employed as tray materials.

Additionally, basket embodiments have been previously discussed that enable bidirectional cooling. As previously explained, some embodiments feature ventilation slots on the hinge and face sides of the basket instead of just the sides as shown in FIG. 4. Such baskets enable cross cooling to pass through the containers.

Figure 5:
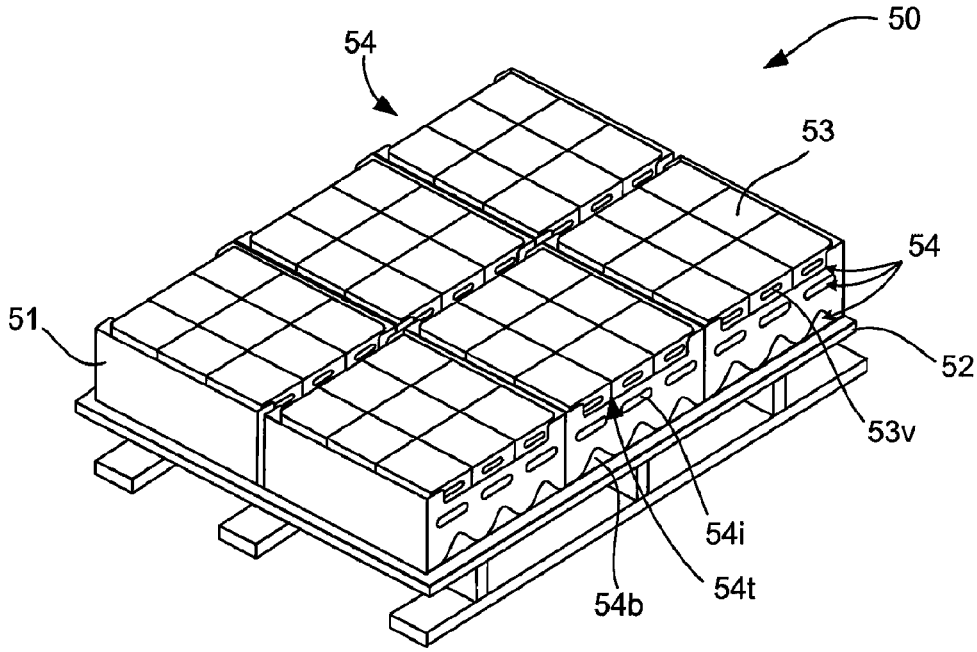
FIG. 5 is a perspective view of a shipping pallet embodiment loaded with trays and packaging containers arranged in accordance with the principles of the invention.

Having reference now to FIG. 5, a significant savings in shipping costs can be realized by sizing baskets and trays as a system to maximize the area or shipping footprint of a layer of trays on a pallet. As previously discussed, the standard 40 inch by 48 inch pallet is the preferred size in the grocery business in the United States. Existing systems only load eight containers per tray and frequently only load five trays on a layer of a 40 inch by 48 inch pallet.

The present inventive system enables nine (9) one pound strawberry baskets, a maximum of 54 pounds of fruit may thus be loaded in each layer of a pallet.

In contrast, in one embodiment of the present invention the baskets are configured to receive one pound of strawberries and are sized in a range of approximately 4½-5½ inches to about 6-6¾ inches with a height in the range of about 3-4½ inches. In one example, a container of about 5¼ inches by 6¼ inches by 3½ inches high, when closed, is used. The substantially, vertical walls enable a container of this size to hold the required 1 lb of produce (e.g., strawberries). The associated inventive tray has an external dimension of about 16"×20" with an interior dimension sized at approximately 14½-15¼ inches×18½-19¾". This size enhances the volume of produce containable in a standard footprint pallet. In another implementation having tighter size range a clamshell of approximately 4½-5½ inches to about 6-6½ inches with a height in the range of about 3-3½ inches can also be used. This change in footprint means that each layer on the previously described pallet can have 54 pounds of produce per layer. This translates into 972 lbs per pallet versus 864 lbs per pallet for the prior art packing methods. This translates into a 12.5 percent increase in fruit volume per pallet. Since shipping and cooling fees are charged on a per pallet basis, the merchant is not paying for wasted shipping volume and his shipping costs are thereby reduced, which can result in further savings to the consumer.

In another embodiment, the one pound of strawberries are arranged in an associated tray of the present invention that is sized and configured to accommodate two layers of baskets for each tray. Again, five or six such trays can be loaded on to a pallet layer. This can facilitate a loading of 1080 baskets per pallet and still maintain a 75" height limit. This translates into a 25 percent increase in fruit volume per pallet. Since fees are charged on a per pallet basis, the merchant is not paying for wasted shipping volume and his shipping costs are thereby reduced, which can result in further savings to the consumer. In one representative example, the freight saved for California strawberry production alone (about 135 million trays of strawberries) could be as high as $65 million, including gas consumption. With the ever rising costs of fuel these numbers could actually be higher at the time of publication of this patent.

With continuing reference to FIG. 5, the inventors point out that the depicted embodiment demonstrates that in another implementation, this embodiment can be used to ship two layers of eight (8) oz. containers. In one particularly suitable implementation, a tray loaded with eighteen (18) "8 oz. raspberry containers" can be arranged in two layers one on top of the other.

Of particular note to such an implementation is the presence of a number of ventilation features 54 in the tray 51. These ventilation features can include top cutouts 54*t* which are arranged on opposite ends of the tray 51 and arranged in alignment with the vent slots 53*v* of the containers to enable airflow to pass through the containers of a tray and then out the backside where it again passes through the containers of other trays in an effective cooling flow until it exits out the backside of the pallet. As previously described, the trays may include bottom cutouts 54*b* near the bottom of the trays (also being arranged on opposite ends of the tray 51) and arranged in alignment with the channels at the bottom of the containers of the lower layer in the tray (not shown in this view). Similar cooling airflow properties are engendered by this configuration.

Additionally, in a two layer stacked container arrangement, intermediate height cutouts 54*i* can be defined in the sidewalls between the first cutout 54*t* and the bottom of the tray. The intermediate height cutouts 54*i* are arranged at a height sufficient to enable alignment with ventilation slots of the containers of the first layer containers (i.e., the ones placed at the bottom of the tray and obscured from view). These intermediate height cutouts 54*i* are arranged in alignment with the vent slots 53*v* of the bottom layer of containers to enable airflow to pass through the containers of a tray and then out the backside where it again passes through the containers of other trays in an effective cooling flow until it exits out the backside of the pallet. Additionally, if desired the intermediate height cutouts 54*i* can be enlarged so that airflow through the cutout 54*i* passes through ventilation channels of the second layer of containers (stacked on the first layer) or alternatively another cutout can be used to accomplish this purpose.

Figure 6:
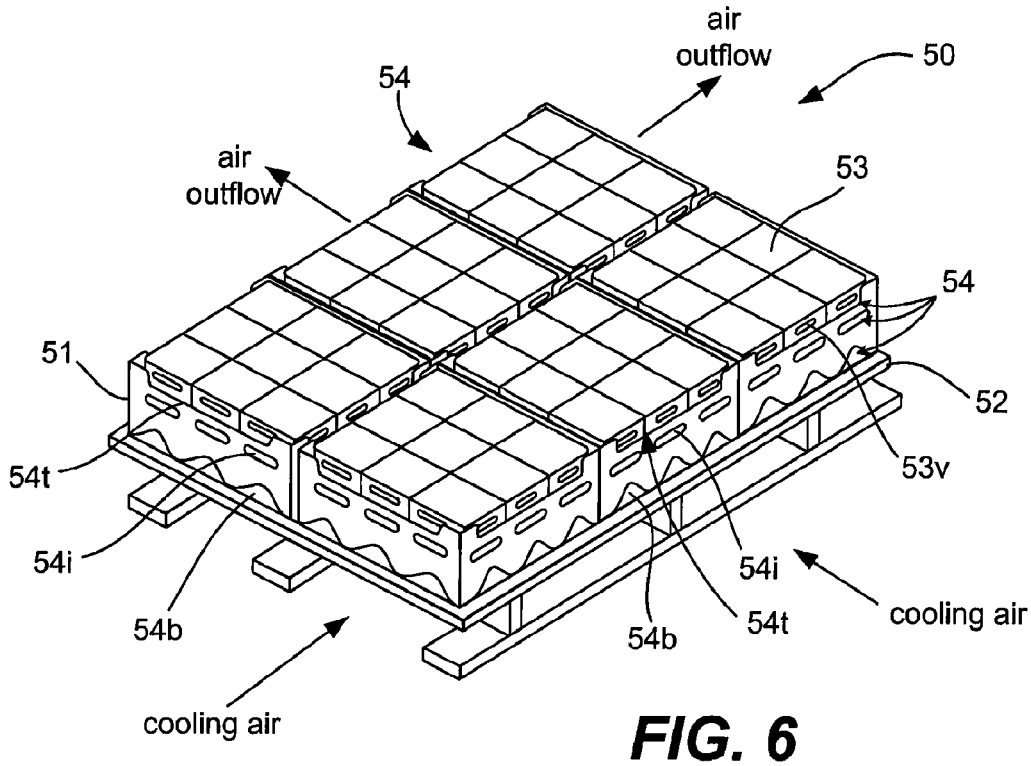
FIG. 6 is a perspective view of another shipping pallet embodiment loaded with trays and packaging containers arranged in accordance with the principles of the invention.

A bi-directional embodiment is briefly described with respect to FIG. 6. This embodiment has been depicted as a two layers embodiment, but can of course be implemented as a single layer bi-directional cooling embodiment. AS with the previous embodiment, this implementation includes a number of ventilation features 54 in the tray 51. However, these ventilation features 54 are formed in each side wall to enable transverse airflows to pass through the trays and containers. Such cooling features can include some or all of the cutouts 54*t*, 54*l*, 54*b*, etc. As before, the cutouts are arranged in alignment with the vent slots 53*v* of the containers (and if desired aligned with the ventilation channels at the bottom of the containers). Such should enable airflow to pass through the containers of a tray and then out the backside where it again passes through the containers of other trays in an effective cooling flow until it exits out the backside of the pallet. The only difference in the depicted embodiment is that transverse airflows are enabled instead of a single uni-directional flow.

The inventors point out that good temperature management involves rapid cooling and maintenance of low fruit temperature. In fact, this has been shown to be the single most important factor in fruit deterioration. This is especially the case for delicate fruit like strawberries, etc. Quick cooling and keeping the pulp temperature low maximize the postharvest life of the fruit.

It is important to cool the fruit as soon as possible after harvesting in order to maintain a maximum post harvest life. Removing the post harvest "field heat" as quickly as possible has proven to be a difficult yet critically important factor in fruit longevity. Additionally, quick cooling reduces produce moisture loss, inhibits the growth and spread of microorganisms, and increases the fruits robustness when subject to bruising and other injuries.

As is known to those having ordinary skill in the art many factors impact berry cooling rate. And it has been determined that keeping berry temperatures near 34° F. (1° C.) is an important factor in berry longevity. An increase of temperature of 10° C. (i.e., from 34° F. to 50° F.) results in a rate of deterioration that is 2-4 times greater than that of berries kept at 34° F. For every hour that a berry is exposed to room temperature, the shelf life is significantly reduced. However, by quickly cooling the berries using pre-cooling and proper storage the shelf life of strawberries can be extended beyond one week. These nine container trays are compact may increase cooling efficiencies.

As described above, the standard pallet is confined to 864 pounds of fruit per pallet versus 1080 pounds (or 972 lbs. depending on configuration) per pallet for the inventive system. This of can add a further 25% to the value of each pallet, which can result in a further $216.00 in increased economic value per pallet. Moreover, when coupled with the advantages of the smooth wall baskets (which lead to less bruising and loss of fruit) a further 7% reduction in fruit damage losses can be obtained. Thus, the system and its unique packing arrangement enables a substantial and unexpected increase in the amount of salable fruit provided to the end user. Additionally, higher packing densities decrease per pallet costs in shipping and cooling. This results in a substantial savings to the grower, merchant, and consumer.

Figure 7A:
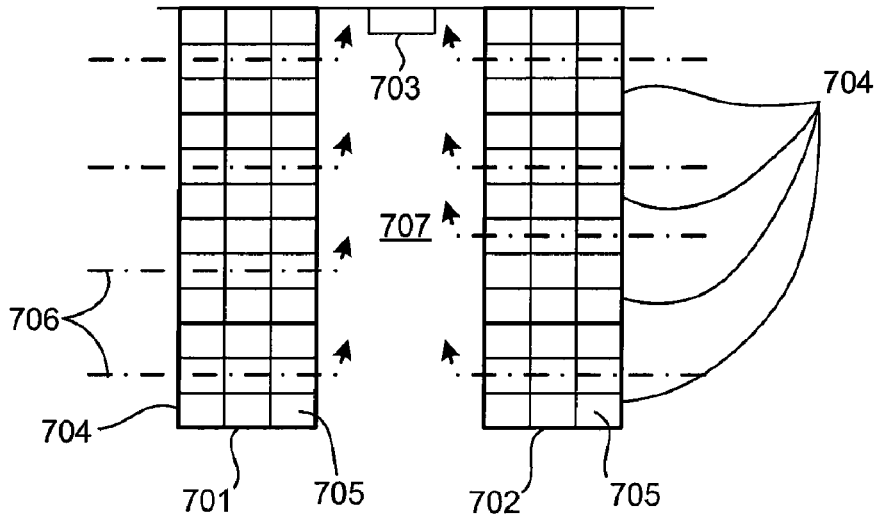
FIGS. 7A & 7B are simplified plan and perspective views (respectively) illustrating air flow processes in accordance with the principles of the invention.
Figure 7B:
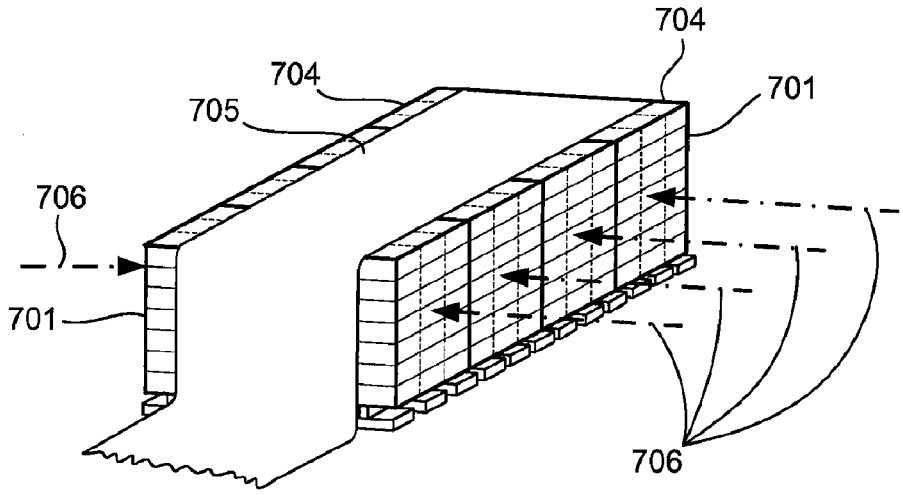

Once the trays are loaded by layers onto a pallet using the inventive system. Several identically oriented layers of trays are stacked on top to fill out each pallet. Various embodiments can be loaded onto the pallet in layers as high as 20 layers high (although more commonly 17 or 18 layers will be used). These pallets are then loaded into a cooler and refrigerated to the desired temperature (usually near 32° F.) where they remain till shipped. FIG. 7A is a top down view of rows 701, 702 of pallets 704 straddling a forced air unit 703. The forced air unit 703 can be used to suck cold air (the dotted dashes arrows 706) from the cooling chamber through the trays 705 and baskets of each pallet 704 and into the open space 707 between the rows. FIG. 7B provides a perspective view of the pallet rows 701, 702 in the cooling process. A cover 708 is laid over the open space 707 between the rows to enable the cool air from the cooling chamber to be sucked through the ventilation openings in the trays 704 where it passes through and/or under the baskets within the trays to effectuate cooling.

The preceding discussion of an embodiment of the present invention has focused on one specific berry package design. It will be immediately obvious to those of ordinary skill in the art that the principles set forth herein are also applicable to a wide range of produce package sizes and utilizations. By way of illustration but not limitation, the present invention specifically contemplates the forming of 1 pint (also sometimes referred to as 8.8 oz., 8 oz., or 250 g.) and ½ pint (also sometimes referred to as 6 oz. or 125 g.) berry baskets, as well as a vast array of different sized baskets configured to receive therein specific produce shapes, types and counts. An example of the latter is the "long stem pack" used in the berry industry for shipping specific package counts of large, premium berries. Furthermore, while the discussion of the principles set forth herein has centered on packages for the berry industry, it is recognized that these principles may be applied with equal facility to the packaging of a broad range of materials including other foodstuffs or any item that would benefit from the advantages set forth herein. Such applications are specifically contemplated. These principles include the use of a family of trays, having fixed "footprints" or lengths and widths, but with whose heights are varied to accommodate baskets having different heights and/or counts per tray. By maintaining the footprint at a constant value, the advantages of minimizing lateral movement between individual trays and between layers of trays are attained because the trays of one layer interlock with the layer of trays above or below it. This is true even where adjacent tray layers contain significantly differing sizes of baskets, holding the same or different produce items.

Where the tray is designed to receive one pound strawberry baskets as previously discussed, the height of the tray varies between about 3½ inches to about 4½ inches. Where other berries, or indeed other produce products are shipped, the length and width of the tray do not change, but remain at the previously defined optimal size. Changes in tray volume necessary to accommodate differing numbers and volumes of baskets are accommodated by altering the height of the tray. In similar fashion, the baskets are designed for a nine basket per tray implementation.

Figure 8:
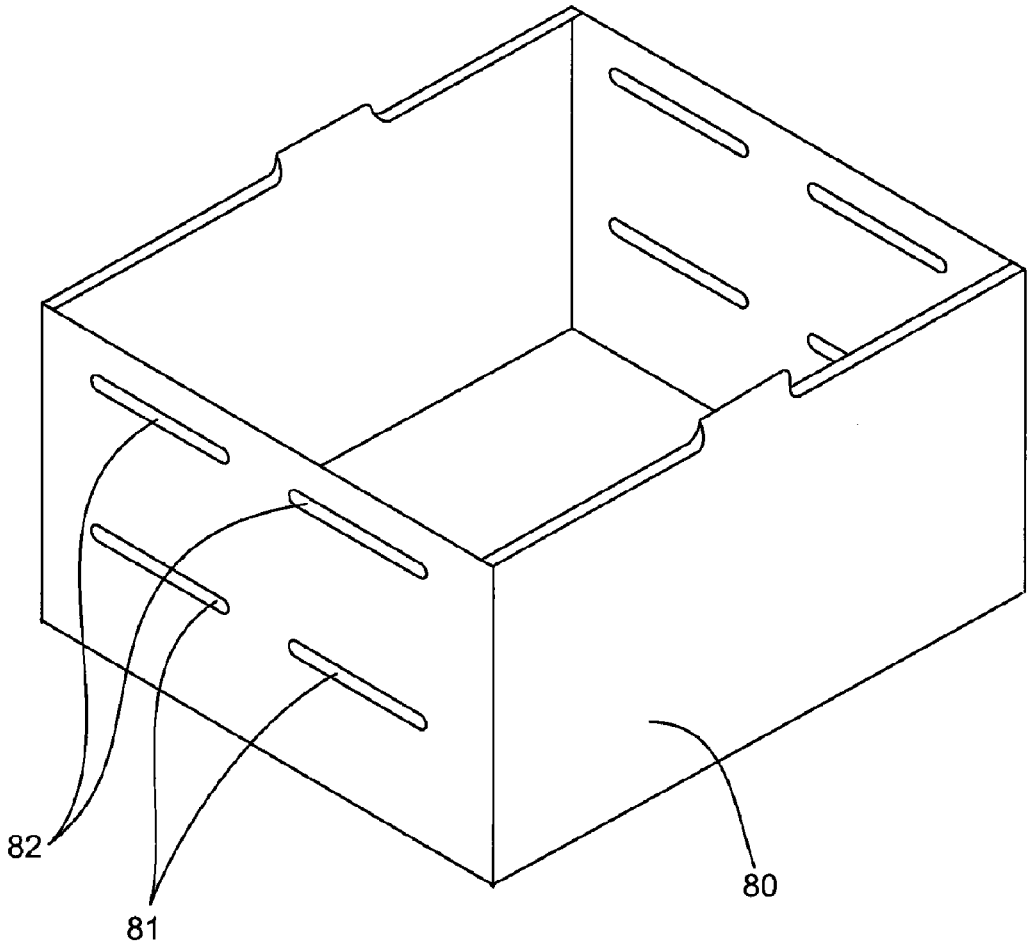
FIG. 8 is a perspective view of another tray embodiment constructed in accordance with the principles of the invention.

FIG. 8 provides a perspective view of another multi-layer tray embodiment 80. The tray 80 is configured so that a first layer of containers can be placed in the tray. A first set of ventilation openings 81 are arranged to align with the ventilation slots of a first layer of baskets positioned in the tray. A second set of ventilation openings 82 are arranged to align with the ventilation slots of a second layer of baskets positioned in the tray on top of the first layer of baskets. As with the other embodiments of the invention, the inventors contemplate that the width of the ventilation openings can be of about the same width as the ventilation slots of the containers. Additionally, another set of ventilation openings can be made near the bottom of the tray to enable a cooling airflow to pass through a cooling channel of the baskets if such a basket embodiment is employed. Also, the first set of ventilation openings 81 can be expanded (for example, widened in a vertical direction) to additionally align with the lower ventilation channels of the second layer of baskets that are positioned on top of the first layer of baskets. Alternatively, a third set of ventilation openings could be positioned between openings 81, 82 to align with the lower ventilation channels of the second layer of baskets to enable airflow through the tray.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. In particular, the use of alternative basket forming technologies, tray forming technologies, basket and tray materials and specifications, basket shapes and sizes to conform to differing produce requirements, and vent configurations are all contemplated by the principles of the present invention. Furthermore, the present invention has been particularly shown and described with respect to certain preferred embodiments and specific features thereof. However, it should be noted that the above-described embodiments are intended to describe the principles of the invention, not limit its scope. Therefore, as is readily apparent to those of ordinary skill in the art, various changes and modifications in form and detail may be made without departing from the spirit and scope of the invention as set forth in the appended claims. Other embodiments and variations to the depicted embodiments will be apparent to those skilled in the art and may be made without departing from the spirit and scope of the invention as defined in the following claims. Although only a few specific configurations are expressly disclosed herein, it should be appreciated by anyone having ordinary skill in the art that, using the teachings disclosed herein, many different packaging configurations can be implemented and still fall within the scope of the claims. Further, reference in the claims to an element in the singular is not intended to mean "one and only one" unless explicitly stated, but rather, "one or more". Furthermore, the embodiments illustratively disclosed herein can be practiced without any element which is not specifically disclosed herein.

I claim:

1. A produce packaging and shipping system configured to enhance cooling properties and increase packing density, the system comprising:

a produce packaging tray having an approximate dimension of about 16 inches by about 20 inches, the tray including a venting arrangement with a first cutout on one end of the tray and a second cutout on an opposite end of the tray from the first cut out;

nine produce packaging containers arranged in the tray, each container including a lid that is connected to a body with a hinge and configured so that the closed container can be secured with latches and further configured such that when the lid is closed it defines at least two horizontal ventilation slots between the lid and body, the slots being disposed at opposing ends of the container, the containers being arranged in the tray in three columns of containers with each column having three rows of containers, with each container adapted to contain about 1 lb of produce product, each container having an exterior width dimension of in the range of about 5inches to about 5½ inches and an exterior length dimension of in the range of about 6 inches to about 6¾ inches, and having substantially vertical sidewalls;

the plurality of containers further arranged inside the tray so that ventilation slots of the packaging containers of each row of containers are in alignment with ventilation slots of other packaging containers in the same row of containers, and wherein the ventilation slots of the packaging containers of each row of containers are in alignment with the ventilation cutouts of the trays, enabling airflow to pass into the tray through the first cutout into the ventilation openings of the containers and through each of the containers by passing through the aligned ventilation slots of the containers and out of the cooling tray through the second cutout at the opposite end of the tray.

2. The system of claim 1 wherein sidewalls of the container are smooth walled.

3. The system of claim 1 wherein the container includes reinforcement ribs.

4. The system of claim 1 further comprising, a pallet having a footprint of about 40 inches by about 48 inches onto which the trays are arranged in a plurality of stacked layers of trays wherein each layer comprises a layer of six trays arranged in two row by three row array of trays so that at least one cutout of each tray is directly adjacent to and in alignment with a cutout of another tray enabling a cooling airflow to pass through a cutout of the trays, through the ventilation slots of the containers enabling the contents of the containers to be cooled, and out of the trays through a tray cutout on an opposing side of the tray.

5. The system of claim 1 further comprising, a pallet having a footprint of about 40 inches by about 48 inches onto which the trays are arranged in a plurality of stacked layers of trays wherein each layer comprises a layer of five trays arranged so that at least one cutout of each tray is directly adjacent to and in at least partial alignment with a cutout of another tray enabling a cooling airflow to pass through a cutout of the trays, through the ventilation slots of the containers enabling the contents of the containers to be cooled, and out of the trays through a tray cutout on an opposing side of the tray.

6. The system of claim 1 further comprising, a pallet having a footprint of about 40 inches by about 48 inches onto which the trays are arranged in a plurality of stacked layers of trays wherein each layer comprises a layer of five trays arranged so that at least one cutout of each tray is directly adjacent to and in at least partial alignment with a cutout of another tray.

7. The system of claim 1 wherein each pallet is configured to contain about 972 pounds of produce product.

8. The system of claim 1 wherein the venting arrangement of the produce packaging tray further includes a first bottom ventilation opening at the base of the tray at one end of the tray and a second bottom ventilation opening at the base of the tray at an opposite end of the tray from the first bottom ventilation opening; and wherein a bottom surface of each container comprises a first ventilation channel and wherein the ventilation channels of each packaging container of each row of containers are in substantial alignment with the bottom ventilation openings of the trays, enabling airflow to pass through the first bottom ventilation opening and under the trays through the ventilation channels and out of the cooling tray through the second bottom ventilation opening at the opposite end of the tray.

9. The system of claim 1 wherein at least one ventilation slot is arranged within the hinge.

10. The system of claim 1 wherein the at least two horizontal ventilation slots are each configured to span a distance of between about ⅓ to about ¾ of the length of the side in which the slot is located.

11. A produce packing method comprising:

providing a produce packaging tray having an approximate dimension of about 16 inches by about 20 inches, the tray including a venting arrangement with a first cutout on one end of the tray and a second cutout on an opposite end of the tray from the first cut out;

providing nine produce packaging containers each configured with a lid connected to a body with a hinge and further configured such that when the lid is closed it defines at least two horizontal ventilation slots between the lid and body, the slots being disposed at opposing ends of the container, with each container adapted to contain about 1 lb of produce product, each container having an exterior width dimension of in the range of about 5 inches to about 5¾ inches and an exterior length dimension of in the range of about 6 inches to about 6¾ inches, and having substantially vertical sidewalls;

arranging the nine containers in the tray into packing layer comprising three columns of containers with each column having three containers, further arranging the nine containers inside the tray so that, ventilation slots of the packaging containers of each column of containers are in substantial alignment with ventilation slots of other packaging containers in the same column of containers, and so that the ventilation slots of the packaging containers of each column of containers are in substantial alignment with the ventilation cutouts of the trays, said arranging enabling airflow to pass into the tray through the first cutout into the ventilation openings of the containers of the arrangement and through each of the containers of the arrangement by passing through the aligned ventilation slots of the containers and out of the cooling tray through the second cutout at the opposite end of the tray.

12. The method of claim 11 wherein having nine produce packaging containers comprises having nine smooth walled produce packaging containers.

13. The method of claim 11 wherein having nine produce packaging containers comprises having nine produce packaging containers with ribbed sidewalls.

14. The method of claim 11 wherein having the tray includes having a tray with, a first bottom ventilation opening at the base of the tray at one end of the tray, and a second bottom ventilation opening at the base of the tray at an opposite end of the tray from the first bottom ventilation opening; and having the nine produce packaging containers further includes containers configured with a bottom surface comprising a ventilation channel and wherein the ventilation channels of each packaging container of are in substantial alignment with the bottom ventilation openings of the trays, enabling airflow to pass through the first bottom ventilation opening and under the trays through the ventilation channels and out of the cooling tray through the second bottom ventilation opening at the opposite end of the tray.

15. The method of claim 11 further comprising, providing a pallet having a footprint of about 40 inches by about 48 inches;

arranging a plurality of layers of trays on a pallet with each layer stacked on another layer, each layer comprising six trays arranged in two rows of trays placed so that a cutout of each tray is directly adjacent to and in alignment with a cutout of another tray; and passing air flow through the trays such that the air flow passes into the cutouts of the trays on a first side of the pallet and through each of the trays and each of the containers within the trays and passing out of the trays through cutouts of the trays on a second side of the pallet opposite the first side.

16. The method of claim 15 wherein passing air flow through the trays comprises:

providing a cooling chamber with a forced air system;

positioning the pallet in the cooling chamber; and passing air flow through the trays of the pallet such that cool air from the chamber passes into the cutout of the trays on a first side of the pallet and through each of the containers and trays and passes out of tray cut outs on a second side of the pallet opposite the first side.

17. The method of claim 16 wherein said passing air flow through the trays comprises:

arranging a plurality of pallets next to each other in rows positioned on either side of the forced air system defining an open space between the rows, wherein the pallets are arranged so that the second sides of the trays face toward the open space and the first sides of the trays face away from the open space;

covering the plurality of pallets and the open space thereby defining an airflow passage in the covered open space, the pallets being covered such that the cutouts in the first side of the tray are exposed to the cooling chamber and cutouts in the second side of the tray are exposed to the covered open space; and operating the forced air system to pull cool air from the cooling chamber into the trays through the first side cutouts, through the ventilation slots of the containers, through the second side cutouts, and into the airflow passage between the rows of pallets, thereby cooling the contents of the containers.

18. A produce packaging and shipping system configured to enhance cooling properties and increase packing density, the system comprising:

a produce packaging tray having a bottom and sidewalls and an approximate dimension of about 16 inches by about 20 inches, the tray including a venting arrangement comprising, a first cutout at a top portion of a first sidewall of the tray at a first end of the tray, a second cutout at a top of a second sidewall of the tray at a second end of the tray at the opposite end of the tray from the first cutout, the first and second cutouts arranged to enable alignment with ventilation slots of containers placed in the tray as a second layer of containers arranged on top of a first layer of containers, the tray further including intermediate height cutouts comprising, a third cutout in the first sidewall between the first cutout and the bottom of the tray, the height of the third cutout arranged so that it can be aligned with ventilation slots of the first layer of containers placed in the tray, and a fourth cutout in the second sidewall between the second cutout and the bottom of the tray, the height of the fourth cutout arranged so that it can be aligned with ventilation slots of the first layer of containers;

the system further including a plurality of produce packaging containers adapted to contain about 8 oz. of produce product, with each container having an exterior width dimension of in the range of about 5 inches to about 5½ inches and an exterior length dimension of in the range of about 6 inches to about 6¾ inches, and having substantially vertical sidewalls, the containers having a lid connected to a body with a hinge and securable in a closed position using latches and further configured such that when the lid is closed it defines at least two horizontal ventilation slots between the lid and body, the slots being disposed at opposing ends of the container, the containers arranged inside the tray as, the first layer of containers arranged on the bottom of the tray, the first layer comprising nine produce packaging containers arranged in three columns of containers with each column having three containers, the plurality of containers further arranged inside the tray so that ventilation slots of the packaging containers of each column of the first layer of containers are in substantial alignment with ventilation slots of other packaging containers in the same column of containers in the first layer and wherein the ventilation slots of the packaging containers of each column of containers in the first layer are in substantial alignment with the third and fourth cutouts of the trays, enabling airflow to pass into the tray through the third cutout, into the ventilation openings of the containers of the first layer and through each of the containers of the first layer by passing through the aligned ventilation slots of the containers and out of the cooling tray through the fourth cutout at the opposite end of the tray, and the second layer of containers comprising nine produce packaging containers arranged on top of the first layer and arranged in three columns of three containers per column, the plurality of containers further arranged inside the tray so that ventilation slots of the containers of each column of the second layer of containers are in substantial alignment with ventilation slots of other packaging containers in the same column of containers of the second layer and wherein the ventilation slots of the packaging containers of each column of the second layer are in substantial alignment with the first and second cutouts of the trays, enabling airflow to pass into the tray through the first cutout, into the ventilation openings of the containers of the second layer and through each of the containers of the second layer by passing through the aligned ventilation slots of the containers and out of the cooling tray through the second cutout at the opposite end of the tray.

19. The system of claim 18 further comprising, a pallet having a footprint of about 40 inches by about 48 inches onto which the trays are arranged in a plurality of stacked layers of trays wherein each layer comprises six trays placed so that at least one cutout of each tray is directly adjacent to and in alignment with a cutout of another tray and so that at least one intermediate height cutout of each tray is directly adjacent to and in alignment with an intermediate height cutout of another tray, the configuration enabling a cooling airflow to pass through a cutout and an intermediate height cutout of the trays into the containers through the ventilation slots of the containers enabling the contents of the containers to be cooled, and out of the trays through a tray cutout and an intermediate height cutout on an opposing side of the tray.

20. A produce packaging and shipping system configured to enhance cooling properties and increase packing density, the system comprising:

a produce packaging tray having a bottom and sidewalls and an approximate dimension of about 16 inches by about 20 inches, the tray including a venting arrangement with a first cutout in a first sidewall at one end of the tray and a second cutout in a second sidewall at an opposite end of the tray from the first cutout;

six produce packaging containers arranged in the tray, each container including a lid that is connected to a body with a hinge and configured so that the closed container can be secured with latches and further configured such that when the lid is closed it defines at least two horizontal ventilation slots between the lid and body, the slots being disposed at opposing ends of the container, the containers being arranged in the tray in two columns of containers with each column having three containers, with each container adapted to contain about 2 lb of produce product;

the plurality of containers further arranged inside the tray so that ventilation slots of the packaging containers are in alignment with ventilation slots of other packaging containers in the tray, and wherein the ventilation slots of the packaging containers are in alignment with the ventilation cutouts of the trays, enabling airflow to pass into the tray through the first cutout into the ventilation openings of the containers and through each of the containers by passing through the aligned ventilation slots of the containers and out of the cooling tray through the second cutout at the opposite end of the tray.

21. The system of claim 20 further comprising, a pallet having a footprint of about 40 inches by about 48 inches onto which the trays are arranged in a plurality of stacked layers of trays wherein each layer comprises a layer of six trays arranged so that at least one cutout of each tray is directly adjacent to and in alignment with a cutout of another tray enabling a cooling airflow to pass through a cutout of the trays, through the ventilation slots of the containers enabling the contents of the containers to be cooled, and out of the trays through a tray cutout on an opposing side of the tray.

22. The system of claim 20 further comprising, a pallet having a footprint of about 40 inches by about 48 inches onto which the trays are arranged in a plurality of stacked layers of trays wherein each layer comprises a layer of five trays arranged so that at least one cutout of each tray is directly adjacent to and in at least partial alignment with a cutout of another tray enabling a cooling airflow to pass through a cutout of the trays, through the ventilation slots of the containers enabling the contents of the containers to be cooled, and out of the trays through a tray cutout on an opposing side of the tray.

23. A produce packaging and shipping system comprising:

a produce packaging tray with a venting arrangement including a first and second cutout wherein the cutouts are arranged at opposite ends of the tray; nine produce packaging containers arranged in the tray, wherein each container includes, a body having substantially vertical sidewalls and a lid connected to the body with a hinge, the container configured so that when the lid is closed it defines at least two horizontal ventilation slots between the lid and body, the slots disposed at opposing ends of the container, and latches configured to secure the container in a closed configuration;

the nine containers being arranged in the tray in three rows of three containers so that the ventilation slots of the containers of each row are in alignment with the ventilation slots of other containers in the same row of containers; and the ventilation slots of the packaging containers of each row of containers are in alignment with the ventilation cutouts of the trays, enabling airflow to pass into the tray through the first cutout into the ventilation openings of the containers and through each of the containers by passing through the aligned ventilation slots of the containers and out of the cooling tray through the second cutout at the opposite end of the tray.

* * * * *